US006154115A

United States Patent [19]

Flohr

[11] Patent Number: 6,154,115

[45] Date of Patent: Nov. 28, 2000

[54] OVERCURRENT RELEASE DEVICE

[75] Inventor: Peter Flohr, Kahl, Germany

[73] Assignee: Heinrich Kopp AG, Germany

[21] Appl. No.: 09/327,718

[22] Filed: Jun. 8, 1999

[30] Foreign Application Priority Data

Oct. 13, 1998 [DE] Germany ..... 198 47 155

[51] Int. Cl.[7] ..... H01H 75/12; H01H 37/52; H01H 37/02

[52] U.S. Cl. ..... 337/13; 337/299; 337/333; 337/3; 337/12; 335/35; 335/36; 335/145

[58] Field of Search ..... 337/13, 14, 333, 337/299, 382, 394, 2, 3, 12, 35, 36, 49, 106, 123, 54; 335/35–37, 23, 145, 172, 173

[56] References Cited

U.S. PATENT DOCUMENTS

| | | | |
|---|---|---|---|
| 4,288,769 | 9/1981 | Howell | 335/173 |
| 4,288,770 | 9/1981 | Gillette | 335/173 |
| 4,595,895 | 6/1986 | Fujii et al. | 335/26 |
| 4,641,001 | 2/1987 | Fujihisa et al. | 200/153 G |
| 5,006,826 | 4/1991 | Knoben et al. | 335/35 |
| 5,103,198 | 4/1992 | Morel et al. | 335/6 |
| 5,107,235 | 4/1992 | Torres-Isea | 335/35 |
| 5,499,007 | 3/1996 | Flohr | 335/201 |
| 5,565,828 | 10/1996 | Flohr | 335/172 |
| 5,973,585 | 10/1999 | Arnhold | 337/13 |

FOREIGN PATENT DOCUMENTS

| | | | |
|---|---|---|---|
| 9637275 C 1 | 11/1986 | Germany | H01H 73/48 |
| 196 29 062 A1 | 7/1996 | Germany | H01H 73/48 |

*Primary Examiner*—Leo P. Picard
*Assistant Examiner*—Anatoly Vortman
*Attorney, Agent, or Firm*—Myers Bigel Sibley & Sajovec

[57] ABSTRACT

An overcurrent release device for protection switching devices, in particular automatic line circuit breakers or motor protective switches, with electromagnetic and thermoelectric release, includes a thermoconducting tubular supporting body onto which a coil is wound and which has a striking end and an opposite widened receiving end for bearing contact and radial support of a bimetal snap-action disk with a central bore, a core having a bore defined therein, an armature movable in the supporting body between its striking end and the core, and a slide extending through the bore in the snap-action disk and through the bore in the core in a direction towards the armature. The slide is provided for thermoelectric disengagement by means of the snap-action disk via a thickened portion and for electromagnetic disengagement by means of the armature via a slide actuator. In the operative state, the spacing between the armature and the core corresponds at maximum to the snapping travel of the snap-action disk.

10 Claims, 3 Drawing Sheets

OVERCURRENT RELEASE DEVICE

FIELD OF THE INVENTION

The present invention relates to an overcurrent release device for electrical protector switchgears, particularly automatic line circuit breakers, with electromagnetic and thermoelectric release.

BACKGROUND OF THE INVENTION

Such an overcurrent release device is disclosed already in the German Patent 36 37 275. That known overcurrent release device is intrinsically safe up to seven times the rated current for the switchgear. For motor protection, however, overcurrent release devices with magnetic response levels up to twenty times the rated current are required, which results in an unprotected range between seven times the rated current and the desired response level of the magnetic release trip in the known overcurrent release device.

From the laid-open German Patent Application DE-OS 19629062 it is moreover known in an improvement of the aforementioned overcurrent release device to hold the armature in a cold state by means of an additional bimetal up to roughly ten times the rated current in the sense of response prevention and to overcome this bimetal mechanically by the magnetic force only at higher currents. When in that known overcurrent release device a current flows in the order between seven and ten times the rated current, i.e. up to the magnetic holding current, a rapid deflection of the bimetal occurs and hence a release of the armature, with the consequence that the critical range of the protective switchgear is thermally protected by means of the magnetic release trip. What must be considered to be a disadvantage in that overcurrent release device, which operates reliably on principle, is the fact that the manufacture of its part requires an extraordinarily high precision which cannot be easily achieved with simple means in series production.

SUMMARY OF THE INVENTION

The invention is accordingly based on the problem of improving an overcurrent release device of the general type mentioned in the Field of Invention, in a way that the intrinsic safety will be ensured for its critical range between seven and ten times the rated current, at a low expenditure in terms of structure.

In accordance with the invention this problem is solved an overcurrent release device for protection switching devices, in particular automatic line circuit breakers or motor protective switches, with electromagnetic and thermoelectric release, consisting of a thermoconducting tubular supporting body onto which a coil is wound and which has a striking end and an opposite widened receiving end for bearing contact and radial support of a bimetal snap-action disk with a central bore, an armature movable in said supporting body between its striking end and said core, and a slide extending through said bore in said snap-action disk and through said bore in said core in a direction towards said armature, aid slide being provided for thermoelectric triggering by means of said snap-action disk acting upon a thickened portion thereof and for electromagnetic triggering by means of said armature acting upon a slide actuator, and wherein, in the operative state, the spacing between said armature and said core corresponds at maximum to the snapping travel of said snap-action disk.

Preferred features for an expedient improvement of the invention are disclosed in the dependent patent claims.

In accordance with the invention the response time of the bimetal disk is expediently strongly shortened in the critical range between seven up to twelve times the rated current, using the magnetic armature, so as to ensure the thermal protection which is required for the intrinsic safety of the switchgear. In this design the magnetic force of the current-carrying coil is employed for acting directly upon the bimetal snap-action disk directly via the armature and a tubular actuator. The bimetal disk expediently functions as armature-securing spring which retains the armature mechanically up to the magnetic response level of the protective switchgear. As soon as the magnetic response level has been reached the armature presses the bimetal disk, via the tubular actuator, beyond its snapping point in such a way that the slide can unlatch the latch of the protective switch gear. When the coil carries current the armature presses on the bimetal snap-action disk more or less strongly, as a function of the current amount, with the effect that within the critical range between seven and ten times the rated current the snapping action of the disk, which is heated via the supporting body, will be accelerated. As a result the snapping period of the snap-action disk is so reduced that the protective switchgear will cut of rapidly and hence with intrinsic safety.

The mutual support of the magnetic armature and the bimetal snap-action disk is provided substantially only in the critical range between seven and ten times the rated current. The release characteristic which is prescribed, for instance, for automatic line circuit breakers, is here achieved by the provision that in the case of higher currents only the magnetic armature and with lower currents only the bimetal snap-action disk becomes effective.

On account of the inventive concept series production can be expediently realized easily with simple means. In view of the small number of simple parts the prerequisite for low-cost production is satisfied, and due to the employment of elements of circular symmetry exclusively, such as the supporting body, armature, tube, slide, core, snap-action disk, O-ring and cover, a combined overcurrent release device is now available which has been designed for fully mechanized series production without additional assembly measures.

What is decisive for the proper functioning of the inventive overcurrent release device is an intimate connection of the bimetal snap-action disk with the supporting body, e.g. via a resilient O-ring, so as to ensure an appropriate heat transmission from the supporting body to the snap-action disk for the electro-thermal release. Moreover, however, it is equally important that in the operative state the distance between the armature and the core (armature air gap) must not exceed the snapping travel of the bimetal disk, so as to make sure that the armature will not deform the snap-action disk mechanically, e.g. in the event of high short-circuit currents.

The slide actuator, which is provided in the inventive overcurrent release device, is preferably passed through the bore of the core and is preferably configured as a tube which is preferred to surround the slide loosely. This results in an extraordinarily compact design of the slide actuator with an optimum power transmission and input into the snap-action disk.

In accordance with another embodiment of the invention the core is adjustably fastened in the supporting body in terms of its position relative to the armature, which provides for an additional potential adjustment of the armature air gap.

The snap-action disk is preferably mounted in the receiving end of the supporting body such that a resilient O-ring acts thereupon at the edge side, with the O-ring being preferably pressed by a lid-shaped cap against the snap-action disk and with the cap presenting a central opening for slide passage.

In correspondence with a preferred embodiment of the invention, the bore in the core is formed to have a leading section for the slide actuator, preferably in the form of a tube guide section, and a section of a comparatively wider diameter, with the core as such being preferably fastened adjacent to the receiving end of the supporting body so as to allow for a compact design of the overcurrent release device.

In accordance with another embodiment of the invention, the armature comprises a rear recess for receiving a vibration damping spring supported at the striking end. With this provision the movement of the armature is expediently counteracted with the mains frequency in such a way that a disturbing noise generation will be reliably prevented.

BRIEF DESCRIPTION OF THE DRAWINGS

The invention will be described in the following in more details with reference to the attached drawing. In the drawing.

DETAILED DESCRIPTION OF THE PREFERRED EMBODIMENT

Figure 1:
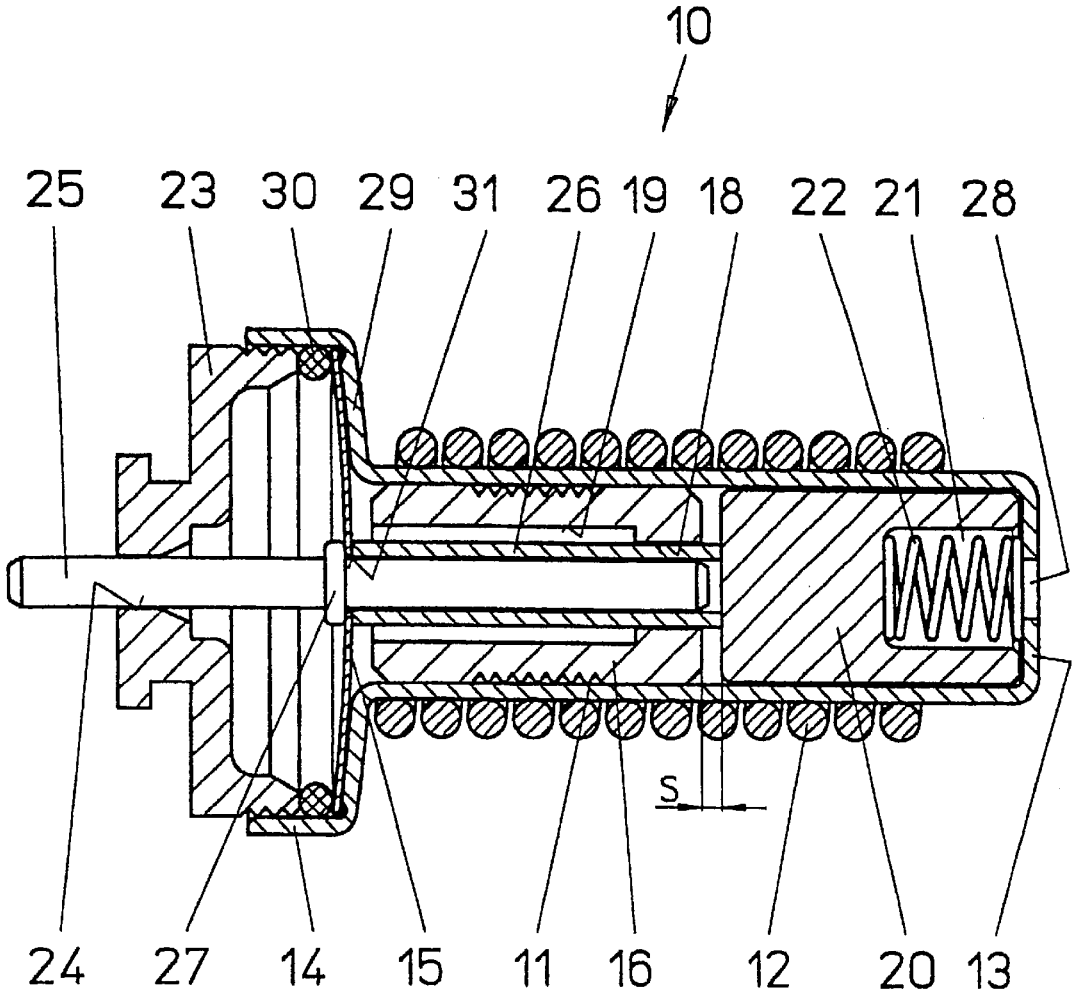
FIG. 1 is a sectional view taken through one embodiment of an overcurrent release device in its position ready for operation.

FIG. 1 is a schematic sectional view taken through an overcurrent release device 10 for protective switchgear, which comprises a thermoconducting tubular supporting body 11 on which a coil 12 is wound. The supporting body 11 has an integrally formed striking end 13 and an opposite widened receiving end 14 for bearing contact and radial support of a bimetal snap-action disk 15.

In the supporting body 11, adjacent to its receiving end 14, a core 16 is fastened which has a central guiding bore 18 and a wider bore 19 with a comparatively wider inner diameter.

Between the core 16 and the striking end 13 of the supporting body 11 an armature 20 is supported for sliding in the tubular supporting body 11, with a spacing s being formed as armature air gap between the core 16 and the armature 20. The armature 20 has a rear recess 21 for receiving a vibration damping spring 22 supported on the striking end 13. This vibration damping spring 22 has merely the function of preventing a disturbing noise generation of the armature 20 as a result of the mains frequency and does not interfere, in terms of function, with the other operational features of the overcurrent release device 10.

The receiving end 14 of the supporting body 11 is closed by means of a cap which, like the supporting body 11, the core 16 and the armature 20, has a rotationally symmetrical configuration. The cap 23 has a central guide opening 24 for guiding a slide 25 which can be disengaged to the left side in FIG. 1. The rear end of the slide 25 projects through a central opening 31 of the snap-action disk 15 and is supported for sliding towards the armature 20 under the action of a tubular actuator 26.

The tubular actuator 26 is supported for rotary displacement by its outside in the guiding groove 18 of the core 16, and bears loosely by its one end against the armature 20 and by its other end against the snap-action disk 15. A thickened portion 27 is provided on the slide 25 in accordance with FIG. 1 such that the bimetal disk 15 is located between the thickened portion 27 and the end of the tubular actuator 26. The striking end 13 moreover presents an opening 28 through which the overcurrent release device can also by manually triggered by pushing in the armature 20. The spacing s between the core 16 and the armature 20 is so selected that it corresponds at least to half of the snapping travel of the snap-action disk 15 and at maximum only to the complete travel, so as to ensure a sufficient functioning, on the one hand, and to avoid any mechanical damage to the snap-action disk 15 when it is triggered by the armature 20.

The snap-action disk 15 is so received and maintained in the receiving section 14 in the operative condition that it is pressed into lateral contact with the bent supporting body section 29 by a resilient O-ring 30 upon which, in its turn, acts the cap 23.

Figure 2:
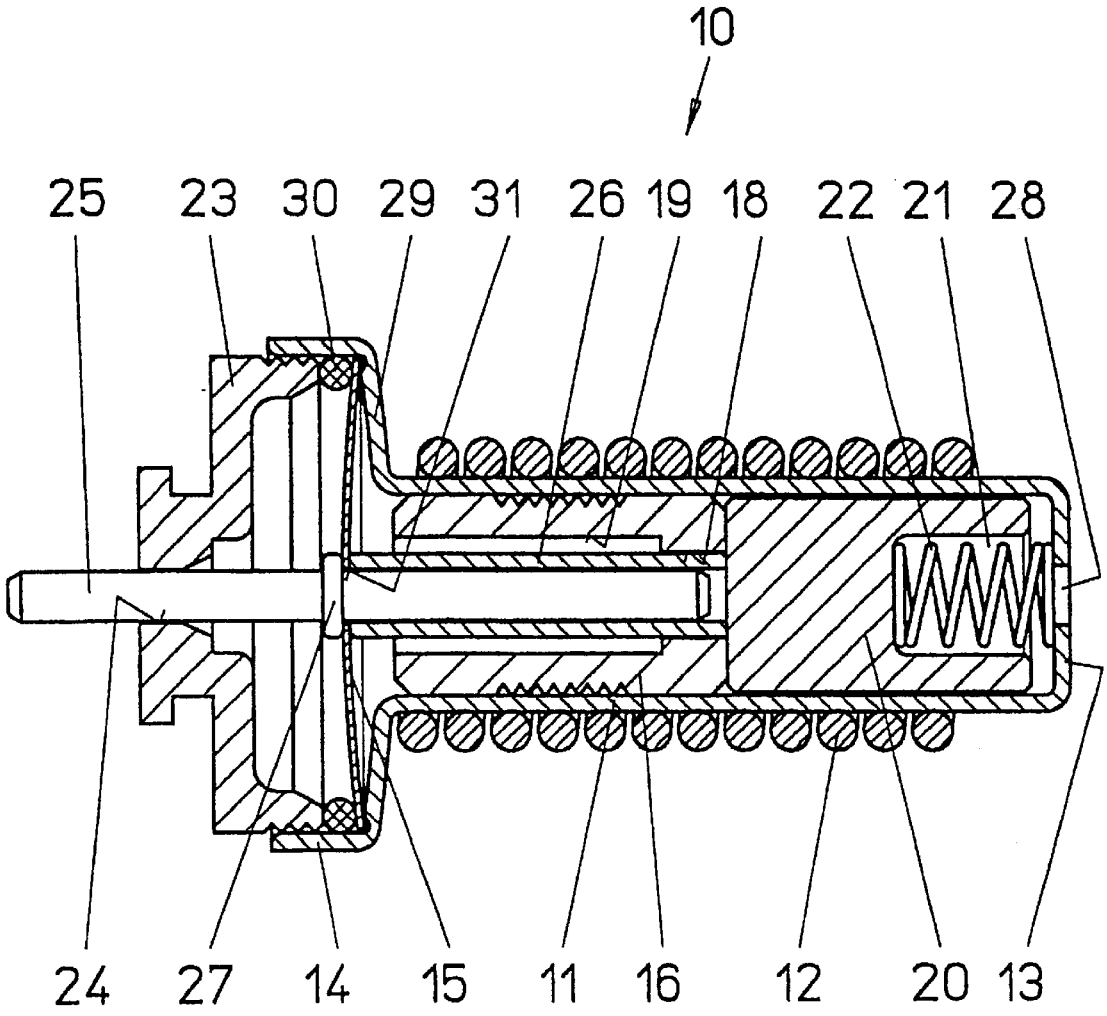
FIG. 2 is a sectional view through the overcurrent release device of FIG. 1 after electromagnetic tripping.

FIG. 2 shows the overcurrent release device 10 after electromagnetic tripping, with the armature 20 bearing against the core 16 and with the snap-action disk 15 having been caused by the tubular actuator 26 to move into the snapping position in which the slide 25 reaches its disengaged release position.

Figure 3:
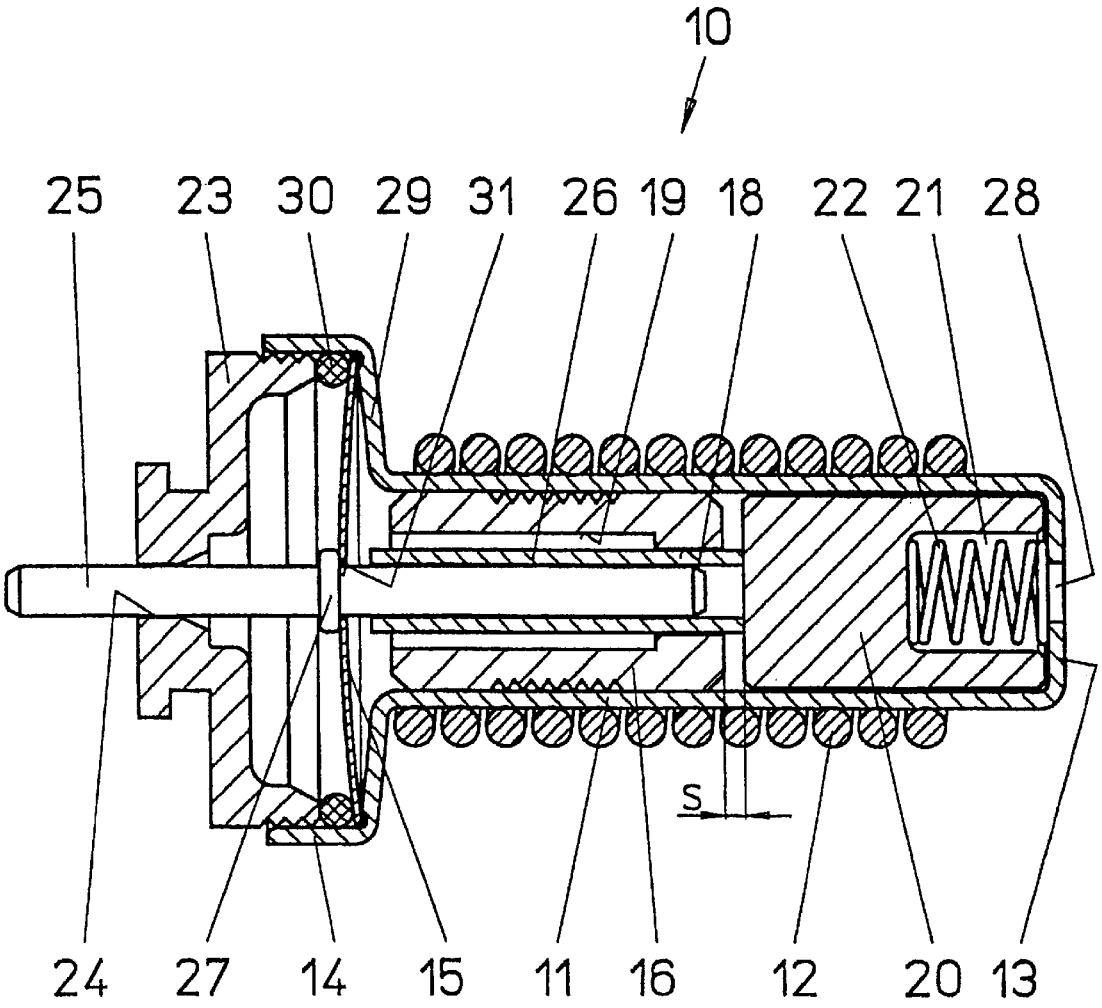
FIG. 3 shows a sectional view of the overcurrent release device of FIG. 1 after electro-thermal tripping.

FIG. 3 illustrates the overcurrent release device 10 after electrothermal tripping merely as a result of the operation of the snap-action disk 15 which during the snapping action engages on the thickened portion 27 of the slide 25 to carry the latter into the illustrated release position.

What is claimed is:

1. An overcurrent release device for protection switching devices, in particular automatic line circuit breakers or motor protective switches, with electromagnetic and thermoelectric release, said overcurrent release device comprising a thermoconducting tubular supporting body onto which a coil is wound and which has a striking end and an opposite widened receiving end for bearing contact and radial support of a bimetal snap-action disk with a central bore, a core having a bore defined therein, an armature movable in said supporting body between its striking end and said core, and a slide extending through said bore in said snap-action disk and through said bore in said core in a direction towards said armature, with said slide being provided for thermoelectric disengagement by means of said snap-action disk via thickened portion and for electromagnetic disengagement by means of said armature via a slide actuator, and wherein, in the operative state, the spacing between said armature and said core corresponds at maximum to the snapping travel of said snap-action disk.

2. An overcurrent release device according to claim 1, wherein said slide actuator is guided through said bore of said core.

3. An overcurrent release device according to claim 1, wherein said slide actuator is a tube.

4. An overcurrent release device according to claim 3, wherein said tube loosely surrounds said slide.

5. An overcurrent release device according to claim 1, wherein said core is adjustably fastened in said supporting body in its position relative to said armature via threading.

6. An overcurrent release device according to claim 1, wherein said snap-action disk in the receiving end of said supporting body has its edge side applied by means of a resilient O-ring.

7. An overcurrent release device according to claim 6, wherein said O-ring is pressed against said snap-action disk by means of a cap, which is fastened in said receiving end and comprises a central opening for passage of said slide.

8. An overcurrent release device according to claim 1, wherein said bore in said core is formed with a slide actuator guiding section and a section having a comparatively wider diameter.

9. An overcurrent release device according to claim 1, wherein said core is fastened adjacent to the receiving end of said supporting body.

10. An overcurrent release device according to claim 1, wherein said armature comprises a rear recess for receiving a vibration damping spring supported on said striking end.

* * * * *